United States Patent [19]

Schwarzwalder

[11] 4,132,379

[45] Jan. 2, 1979

[54] METHOD FOR IMPROVING THE STOPPING ACCURACY AT RAILWAY STATIONS OF TRACK-BOUND VEHICLES

[75] Inventor: Jörg Schwarzwalder, Stuttgart, Germany

[73] Assignee: International Standard Electric Corporation, New York, N.Y.

[21] Appl. No.: 845,704

[22] Filed: Oct. 26, 1977

[30] Foreign Application Priority Data

Oct. 28, 1976 [DE] Fed. Rep. of Germany ..... 2648943

[51] Int. Cl.[2] ..... B61L 3/12

[52] U.S. Cl. ..... 246/167 R; 246/187 B

[58] Field of Search ..... 246/34 R, 34 CT, 122 R, 246/167 R, 63 R, 63 C, 182 B, 187 B

[56] References Cited

U.S. PATENT DOCUMENTS 3,772,640 11/1973 Auer, Jr. et al. ..... 246/63 C X 4,034,942 7/1977 Feucht et al. ..... 246/167 R X

FOREIGN PATENT DOCUMENTS 1079670 4/1960 Fed. Rep. of Germany ..... 246/187 B

*Primary Examiner*—Stephen G. Kunin

*Attorney, Agent, or Firm*—John T. O'Halloran; Alfred C. Hill

[57] ABSTRACT

Improved stopping accuracy of track-bound vehicles at railway stations is obtained by spacing the phase reversal points of the track conductors at shorter intervals in the station area than on the line and, during a vehicle's approach to a stop, transmitting the exact location of the stopping point between any two phase reversal points to the vehicle, and activating the vehicle's own phase reversal detection logic for the duration of its stay in the station area.

2 Claims, 1 Drawing Figure

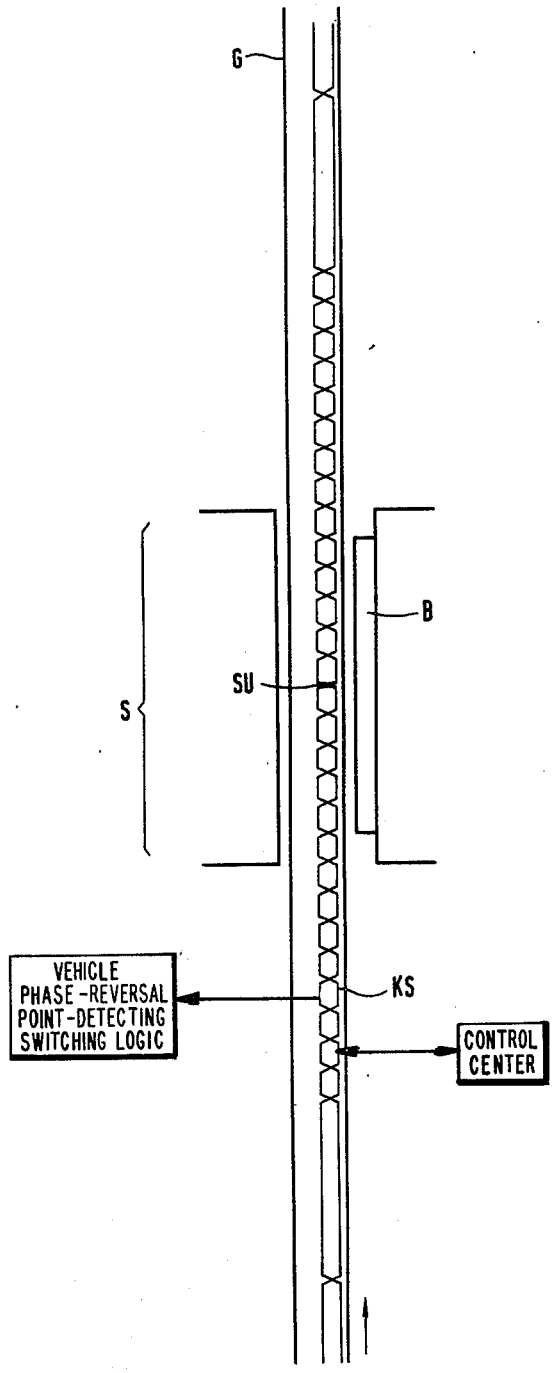
G
B
SU
S
VEHICLE PHASE-REVERSAL POINT-DETECTING SWITCHING LOGIC
KS
CONTROL CENTER

METHOD FOR IMPROVING THE STOPPING ACCURACY AT RAILWAY STATIONS OF TRACK-BOUND VEHICLES

FIELD OF THE INVENTION

The present invention relates to a system for improving the stopping accuracy at railway stations of track-bound vehicles to which a fixed control center transmits data telegrams over continuous track conductors.

DESCRIPTION OF THE PRIOR ART

In continuous automatic train control, the locations of the vehicles are determined with the aid of phase reversal points obtained by either transposing continuous track conductors or by means of phase reversal transformers. Between these fixed points, the vehicles determine their locations with a high degree of accuracy by counting wheel revolutions. This accurate determination of a vehicle's location may be erroneous due to wear of the wheel rims and to wheel slip. The greater the distance between the phase reversal points are chosen, the greater these errors can be. For economic and transmission reasons, the distances between the phase reversal points are made > 100 m.

Phase jumps may also occur at transitions between two track conductor loops fed from different sources and may simulate a phase reversal point. Therefore, the on-board logic on the vehicle for detecting phase reversal points is activated only within a limited zone about the phase reversal point ("window").

In the known systems, distance remaining to the stopping point is given by the so-called command variable, which is transmitted to the vehicle in steps of 12.5 m.

With this known method, a stopping accuracy of ± 6.25 m plus location error is achievable. This is too inaccurate for short-distance traffic systems and makes it almost impossible to automatically arrange two rail cars one behind the other at a platform.

SUMMARY OF THE INVENTION

The object of the invention is to considerably improve the stopping accuracy at railway stations.

The system according to the invention is characterized in that the phase reversal points in the station area are spaced at much shorter intervals than those on the line, and that during the approach to a station stop, a special message giving the exact location of the stopping point between two phase reversal points and causing the switching logic for detecting the phase reversal points to be permanently switched on is communicated to the vehicles within the data telegrams.

With this system, the determination of a vehicle's location in the station area and, consequently, the stoppingaccuracy are improved to the point that a vehicle can be brought to a stop within 5 cm accuracy. This makes it possible to arrange several vehicles one behind the other on one track without any loss of safety.

A development of the system according to the invention serves to suppress noise which may be caused by transitions from one loop to another because the switching logic for detecting the phase reversal points is constantly "on," and is characterized in that necessary transitions between loops are located at points of the close sequence of phase reversal points.

BRIEF DESCRIPTION OF THE DRAWING

An embodiment of the system according to the invention will now be described with reference to the accompanying drawing, which shows how the phase reversal loop is laid near a railway station.

DESCRIPTION OF THE PREFERRED EMBODIMENT

About 200 m ahead of a station S with a platform B begins a zone where the phase reversal points are spaced at shorter intervals KS each of which is about 25 m long. This zone extends beyond the station. With reversable line working, this zone should begin and end on both sides at equal distances from the station. A loop transition SU is located exactly at a place where otherwise there would be a phase reversal point. Therefore, it is not registered by the phase-reversal-detecting logic.

What is claimed is:

1. In a method for improving the stopping accuracy at railway stations of track-bound vehicles to which a fixed control center transmits data telegrams over continuous track conductors and in which said vehicles determine their location by counting phase reversal points of said continuous track conductors, said phase reversal points being counted only within a window formed by activating a phase-reversal-point-detecting switching logic in the immediate vicinity of said phase reversal points, the improvement comprising the steps of:

spacing a plurality of said phase reversal points in an area of said stations at much shorter and substantially equal intervals than those of said phase reversal points remote from said area of said stations, and during the approach of a vehicle to a station stop, transmitting to said vehicle a special message giving the exact location of a stopping point between two adjacent ones of said phase reversal points in said area of said stations, said message causing said switching logic to be permanently switched "on".

2. The method of claim 1, comprising further the step of:

locating any necessary transitions between adjacent ones of said phase-reversal points in said shorter interval of phase reversal points.

* * * * *